US006420973B2

(12) United States Patent
Acevedo

(10) Patent No.: US 6,420,973 B2
(45) **Date of Patent: *Jul. 16, 2002**

(54) WIRELESS SMOKE DETECTION SYSTEM

(76) Inventor: James Acevedo, 136 N. Ocean Ave., Freeport, NY (US) 11520

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,203

(22) Filed: Jan. 23, 1999

(51) Int. Cl.[7] ..... G08C 17/10

(52) U.S. Cl. ..... 340/628; 340/539; 340/573; 340/522; 340/524; 340/525; 439/948; 439/485; 439/692

(58) Field of Search ..... 340/628, 539, 340/573, 429, 522, 524, 525; 439/948, 485, 692

(56) References Cited

U.S. PATENT DOCUMENTS

| | | | | | |
|---|---|---|---|---|---|
| 4,101,872 | A | * | 7/1978 | Pappas | 340/539 |
| 4,189,720 | A | * | 2/1980 | Lott | 340/539 |
| 4,282,519 | A | | 8/1981 | Haglund et al. | 340/628 |
| 4,363,031 | A | | 12/1982 | Reinowitz | 340/539 |
| 4,417,235 | A | * | 11/1983 | Del Grande | 340/531 |
| 4,594,581 | A | * | 6/1986 | Matoba | 340/531 |
| 4,876,713 | A | * | 10/1989 | Crosby et al. | 379/412 |
| 5,159,315 | A | * | 10/1992 | Schultz et al. | 340/539 |
| 5,422,626 | A | * | 6/1995 | Fish | 340/539 |
| 5,461,365 | A | * | 10/1995 | Schlager et al. | 340/573 |
| 5,486,811 | A | * | 1/1996 | Wehrle et al. | 340/522 |
| 5,499,014 | A | * | 3/1996 | Greenwaldt | 340/539 |
| 5,568,535 | A | * | 10/1996 | Sheffer et al. | 379/39 |
| 5,587,705 | A | | 12/1996 | Morris | 340/628 |
| 5,604,478 | A | * | 2/1997 | Grady et al. | 340/330 |
| 5,686,896 | A | * | 11/1997 | Bergman | 340/636 |
| 5,745,040 | A | | 4/1998 | Loughridge | 340/628 |
| 5,774,038 | A | | 6/1998 | Welch et al. | 340/286.05 |
| 5,786,767 | A | * | 7/1998 | Severino | 340/628 |
| 5,889,468 | A | * | 3/1999 | Banga | 340/628 |
| 5,898,369 | A | | 4/1999 | Godwin | 340/539 |
| 5,949,332 | A | * | 9/1999 | Kim | 340/539 |
| 5,952,926 | A | * | 9/1999 | Syverson | 340/573.3 |
| 5,973,603 | A | * | 10/1999 | Judy | 340/628 |

* cited by examiner

*Primary Examiner*—Daniel J. Wu
*Assistant Examiner*—Tai T. Nguyen
(74) *Attorney, Agent, or Firm*—Kenyon & Kenyon

(57) ABSTRACT

A wireless detection system for monitoring a predetermined area for an emergency situation. The wireless smoke detection system includes a plurality of detector units strategically positioned throughout the monitored area. Each of the plurality of detector units include a detector for sensing one of a characteristic and condition within a section of the monitored area and generating a signal indicative of the monitored. A signal processor is connected within each detector unit for analyzing the signal generated by the detector and upon determining if the signal is above a predetermined level generating an emergency signal. A transmitter is provided for transmitting the emergency signal to a plurality of receiver units strategically positioned about the monitoring area. Each receiver unit includes an alarm for generating an alarm signal and thereby alert persons to the emergency situation at a position within the monitored area. The detector can be at least one of a photoelectric smoke detector, an ionization type detector, a combination carbon monoxide and smoke detector, a carbon monoxide detector, a near infrared detector and a hazard detector.

1 Claim, 10 Drawing Sheets

WIRELESS SMOKE DETECTION SYSTEM

BACKGROUND OF THE INVENTION

1. Field of the Invention

The present invention relates generally to alarms and, more specifically, to a smoke detection system able to detect smoke in any area of a structure and wirelessly transmit an alarm signal to receivers positioned throughout the structure, alerting occupants throughout the structure as to the detected situation.

2. Description of the Prior Art

Numerous types of smoke alarms have been provided in the prior art. For example, U.S. Pat. Nos. 5,587,705; 5,745,040; 5,774,038 and 5,786,767 all are illustrative of such prior art. While these units may be suitable for the particular purpose to which they address, they would not be as suitable for the purposes of the present invention as heretofore described.

U.S. Pat. No. 5,587,705

Inventor: Gary J. Morris

Issued: Dec. 24, 1996

The battery powered smoke detector of this invention is designed to provide an early warning of the presence of an environmental condition of fire or smoke to persons in remote areas of a building with respect to the location of the environmental condition. The smoke detector sensing the environmental condition emits an audible alarm of continuous tone, while emitting a frequency modulated radio signal directly to other like smoke detectors to activate their alarms in a manner indicative of the location of the smoke detector sensing the environmental alarm condition. Rechargeable light modules separate from the smoke detector are included that receive the frequency modulated radio signal from the smoke detector sensing the environmental alarm condition and illuminate paths of egress for the duration of the alarm condition or in the case of 120V AC power failure. All components of the system are easy to install due to the modular design and conventional power sources. An intermittent activation of the frequency modulated receiving circuitry in the smoke detector unit conserves battery energy.

U.S. Pat. No. 5,745,040

Inventor: Lisa M. Loughridge

Issued: Apr. 28, 1998

An outdoor alerting device for smoke alarms including an alarm detecting and alerting device drive unit and an exterior alerting device including a loudspeaker installed within a housing and a light display unit attached to the housing and having a light bulb. The alarm detecting and alerting device drive unit includes an alarm detection circuit including a microphone having a microphone output in electrical connection with an amplifier circuit for converting the audible alarm into an amplified electrical microphone signal. The amplified electrical microphone signal is then passed through a band pass filter that is tuned to the main audible output frequency of the audible alarm of the smoke detector to produce a filtered microphone signal. The filtered microphone signal is then passed through a rectifier circuit to convert the filtered microphone signal into a DC microphone signal. The DC microphone signal is then output to the signal input of a comparator. The reference input of the comparator is supplied with a predetermined reference voltage such as through a voltage divider circuit. The output of the comparator is used to trigger the exterior alerting device after being passed through a delay network.

U.S. Pat. No. 5,774,038

Inventor: Dana L. Welch et al.

Issued: Jun. 30, 1998

This invention relates to an improved safety monitor which comprises a main monitor and a remote monitor which are in communication with each other. The main monitor has a main monitor detector and a main monitor fire/smoke alarm integrally electronically connected to a main monitor microprocessor. The main monitor detector is selected from a group consisting of monitor carbon monoxide detector, monitor carbon dioxide detector and monitor radon detector. The main monitor detector and the main monitor fire/smoke alarm send a warning signal to the remote monitor to alert the user of an adverse condition and which type. A charger base is provided to hold the main monitor and the remote monitor as well as charge the main monitor battery and remote monitor battery.

U.S. Pat. No. 5,786,767

Inventor: Joseph Severino

Issued: Jul. 28, 1998

A home safety system comprising a smoke detector, a carbon monoxide detector and a microphone connected to a transmitter. The smoke detector is powerable by a/c current and by a battery and comprises a sensor for sensing smoke connected to an audible alarm signal. The carbon monoxide detector is powerable by a/c current and by a battery and comprises a sensor for sensing the presence of carbon monoxide connected to an audible alarm signal. The transmitter comprises means for communicating signals from the carbon monoxide detector and smoke detector to a remote location. The invention further comprises an emergency lighting system connected to the carbon monoxide detector and smoke detector. The light system is powered by a battery and adapted to turn on in the event of a power failure, a signal from the smoke detector or a signal from the carbon monoxide detector. The lighting system can also be used as a night light. A portable receiver receives signals from the transmitter and broadcasts the signals to alert an individual monitoring the conditions to the presence of smoke or carbon monoxide.

SUMMARY OF THE PRESENT INVENTION

The present invention relates generally to alarms and, more specifically, to a smoke detection system able to detect smoke in any area of a structure and wirelessly transmit an alarm signal to receiver units positioned throughout the structure, alerting occupants throughout the structure as to the detected situation.

A primary object of the present invention is to provide a wireless smoke detection system that will overcome the shortcomings of prior art devices.

Another object of the present invention is to provide a wireless smoke detection system which is able to provide communication between a plurality of detector units and a plurality of receiver units positioned within an area or structure to be monitored.

A further object of the present invention is to provide a wireless smoke detection system which is able to monitor a plurality of hazardous conditions and relay an emergency signal to other receivers in the system upon detection of an emergency situation.

A yet further object of the present invention is to provide a wireless smoke detection system wherein the system is provided to alert individuals within a structure or area being monitored as to the existence of an emergency situation within the area or structure.

A still further object of the present invention is to provide a wireless smoke detection system including a plurality of detector units able to communicate wirelessly with receiver units whereby one of the detector units is able to trigger generation of an alarm signal to the receiver units upon detection of an emergency situation.

A further object of the present invention is to provide a wireless smoke detection system wherein the detector units are able to detect at least one of smoke, carbon monoxide and any other hazard above a predetermined level.

Another object of the present invention is to provide a wireless smoke detection system wherein each of the detector units are strategically positioned in the area to be monitored and include both a transmitter and receiver.

Another object of the present invention is to provide a wireless smoke detection system that is simple and easy to use.

A still further object of the present invention is to provide a wireless smoke detection system that is economical in cost to manufacture.

Additional objects of the present invention will appear as the description proceeds.

A wireless detection system for monitoring a predetermined area for an emergency situation is described by the present invention. The wireless smoke detection system includes a plurality of detector units strategically positioned throughout the monitored area. Each of the plurality of detector units include a detector for sensing one of a characteristic and condition within a section of the monitored area and generating a signal indicative of the monitored. A signal processor is connected within each detector unit for analyzing the signal generated by the detector and upon determining if the signal is above a predetermined level generating an emergency signal. A transmitter is provided for transmitting the emergency signal to a plurality of receiver units strategically positioned about the monitoring area. Each receiver unit includes an alarm for generating an alarm signal and thereby alert persons to the emergency situation at a position within the monitored area. The detector can be at least one of a photoelectric smoke detector, an ionization type detector, a combination carbon monoxide and smoke detector, a carbon monoxide detector, a near infrared detector and a hazard detector.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
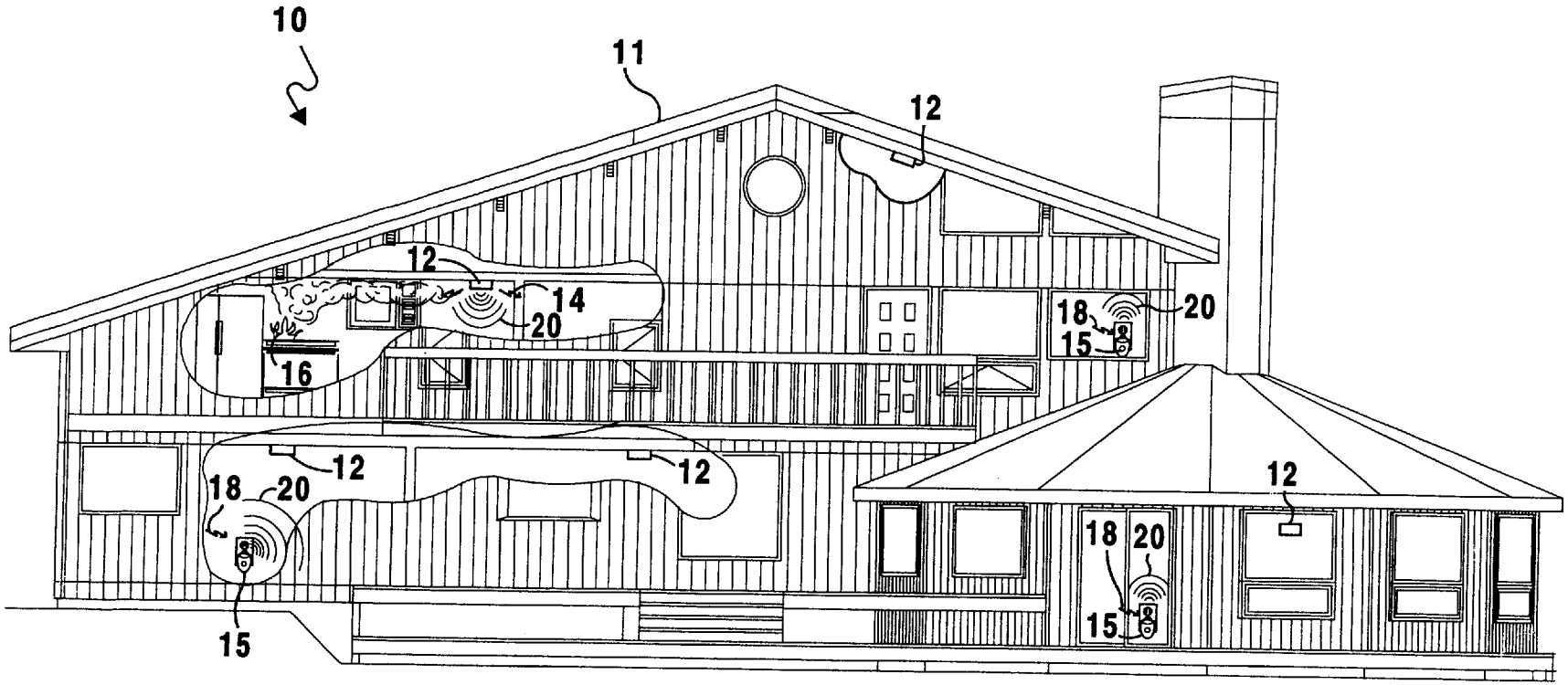
FIG. 1 is a perspective view of a structure being monitored by the wireless smoke detection system of the present invention.

Turning now descriptively to the drawings, in which similar reference characters denote similar elements throughout the several views, the Figures illustrate the wireless smoke detection system of the present invention. With regard to the reference numerals used, the following numbering is used throughout the various drawing figures.

10 wireless smoke detection system of the present invention
11 structure being monitored by wireless smoke detection system
13 detector unit
14 arrow indicating transmission of a signal upon detecting an emergency
15 receiver unit
16 fire within a room of the structure
18 arrow indicating receipt of transmitted signal
20 lines representing audible alarm signal
22 visual indicator alarm
24 audible alarm
26 transmitter within detector unit
28 detector within detector unit
30 alarm within detector unit
31 alarm within receiver unit
32 receiver within receiver unit
33 conventional electrical outlet
34 processor
35 housing of receiver unit
36 power supply
37 power indicator light of receiver unit
38 encoder
39 stabilizing foot of receiver unit
40 timer

41 audible alarm of receiver unit
42 amplifier
44 decoder
46 near infrared smoke detector
48 code switch of encoder
50 encoder
52 code switch of decoder
53 transmitter unit
54 near infrared detector
56 infrared detector signal processor
58 receiver section
60 audible alarm driver
62 ion gauge
64 ion gauge siginal processor
66 photoelectric diodes
68 photoelectric signal processor

DETAILED DESCRIPTION OF THE PREFERRED EMBODIMENT

Turning now descriptively to the drawings, in which similar reference characters denote similar elements throughout the several views, FIGS. 1 through 11 illustrate the wireless smoke detection system of the present invention indicated generally by the numeral 10.

The wireless smoke detection system 10 is illustrated installed in a building 11 in FIG. 1. As shown in this figure, the wireless smoke detection system 10 includes a plurality of detector units 12 and a plurality of receiver units 15 strategically positioned throughout the building I1. The detector units 12 constantly monitor a defined section of the building 11 for a hazardous situation. When a hazardous situation such as the fire 16 is detected by one of the detector units 12, the detector unit 12 sensing the fire 16 will generate and transmit an alarm signal represented by the arrow labeled with the numeral 14. The transmitted signal 14 is received by the receiver units 15 of the system 10 as indicated by the arrow labeled 18. Receipt of the transmitted signal 14 alerts the receiver units 15 to the detected emergency situation and causes the alarm of the individual receiver units 15 to be triggered. The audible alarm being generated by the detector unit sensing the emergency situation and the receiver units 15 upon receipt of the signal 18 is indicated by the arced lines labeled with the numeral 20. Generation of the audible signal 20 alerts persons within the areas of the building 11 monitored by the system 10 to the emergency situation.

Figure 2:
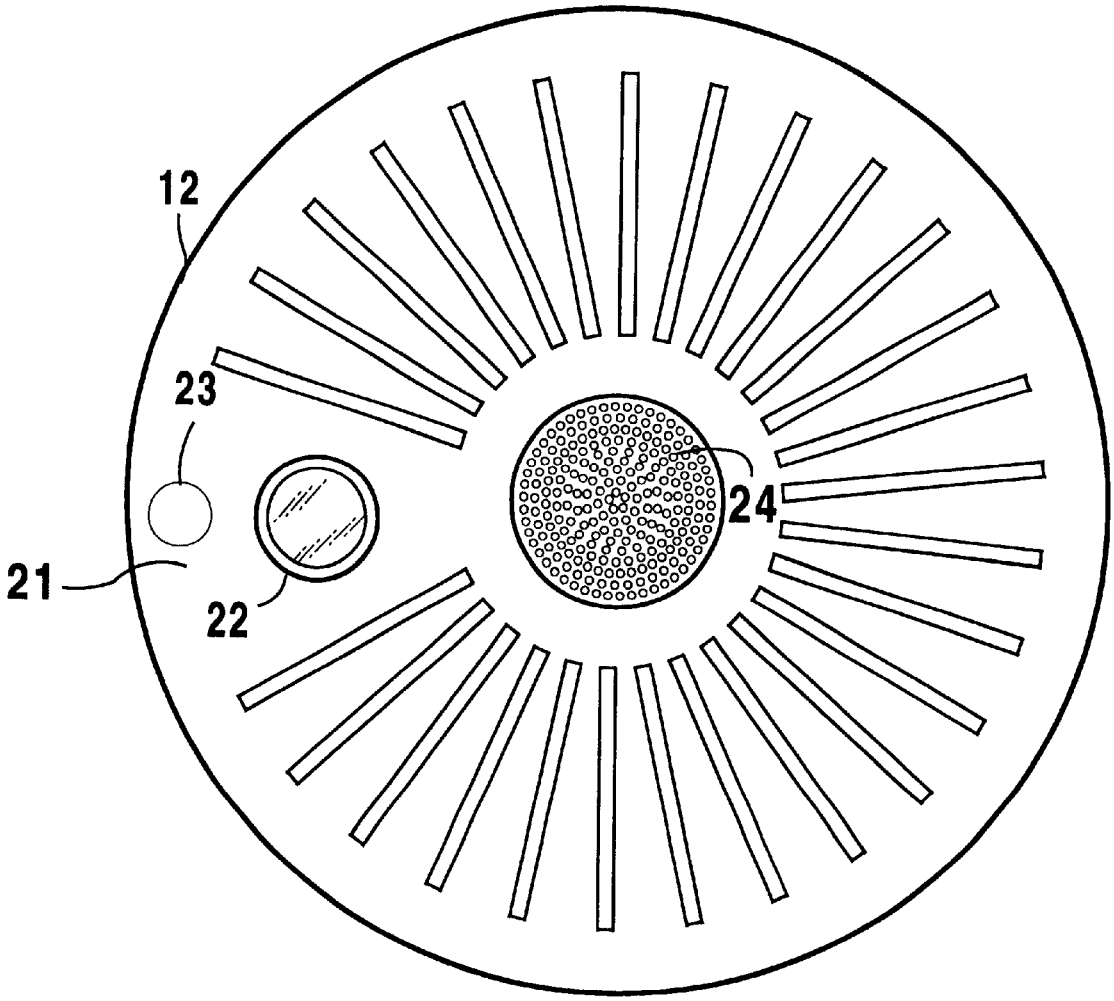
FIG. 2 is a front view of a detector and transmitter of the wireless smoke detection system of the present invention.

A front view of a detector unit 12 is illustrated in FIG. 2. From this view a face side 21 of the detector unit 12 is visible. Positioned on the face side 21 is a visible alarm indicator 22, a power indicator 23 and a speaker 24 of the audible alarm. In the figures the visual alarm is illustrated as a LED and the audible alarm is indicated as a horn for purposes of example only. In practice, the visual alarm may be any device able to produce a visible alarm signal able to alert a person within a predefined area as to the existence of an emergency situation and the audible alarm may be any device able to produce an audible alarm signal able to alert a person within a predefined area as to the existence of an emergency situation. The power indicator 23 will continually flash to indicate that sufficient power is being supplied to the unit 12. When an emergency situation is detected by one of the detector units 12 of the system 10, the visual alarm indicator 22 will illuminate and the speaker 24 will provide an audible alarm. Both the visual and audible alarms will alert persons within the vicinity of the triggered detector unit 12 as to the detection of an emergency situation. The detector unit 12 sensing the alarm will then transmit an alarm signal to all of the receiver units 15 causing the receiver units 15 to generate an alarm signal and alert persons in the vicinity of the receiver units to the existence of the emergency situation and to the need to possibly evacuate the monitored area.

Figure 3:
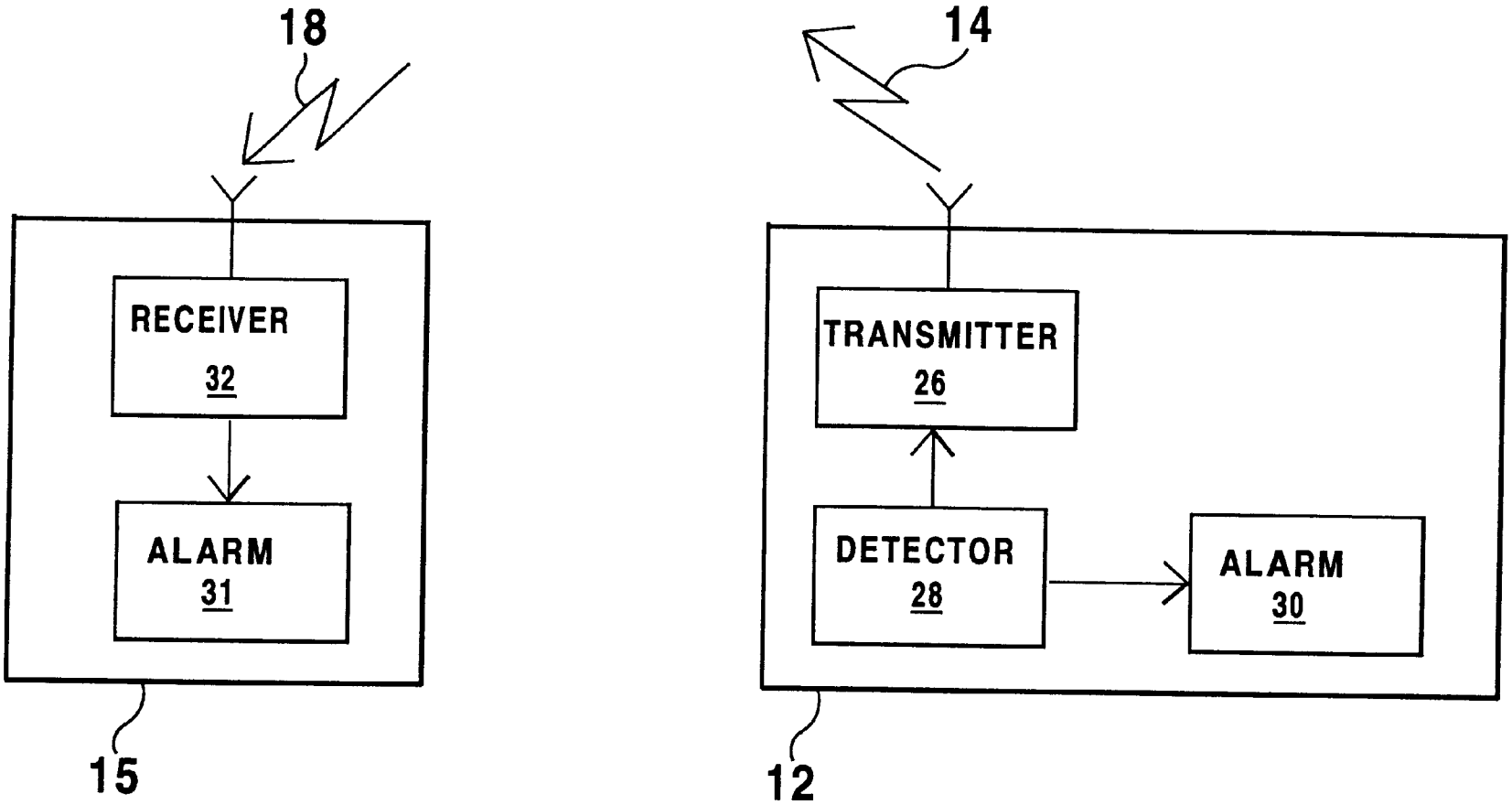
FIG. 3 is a block diagram of a detector and receiver of the wireless smoke detection system of the present invention, one detector triggering the receiver alarm upon detection of an emergency situation.

A block diagram of a detector unit 12 communicating with a receiver units 15 is illustrated in FIG. 3. This figure illustrates a detector unit 12 including a transmitter 26 connected to a detector 28. The detector 28 is also connected to an alarm 30. The alarm 30 generates the audible and visible alarm signals discussed above. When a detector unit 12 detects an emergency situation a signal is provided from the detector 28 to the transmitter 26 indicative of the sensed emergency situation. The transmitter 26 will then transmit an emergency signal 14 at a predetermined frequency to the receiver units 15 of the system 10 within the monitoring area. The receiver units 15 include a receiver 32 tuned to the correct frequency and an alarm 31. Upon receipt of the transmitted signal 18 indicated by the arrow labeled 18 at the receiver units 15, the alarm 31 will be triggered to generate a visual and audible alarm signal.

Figure 5:
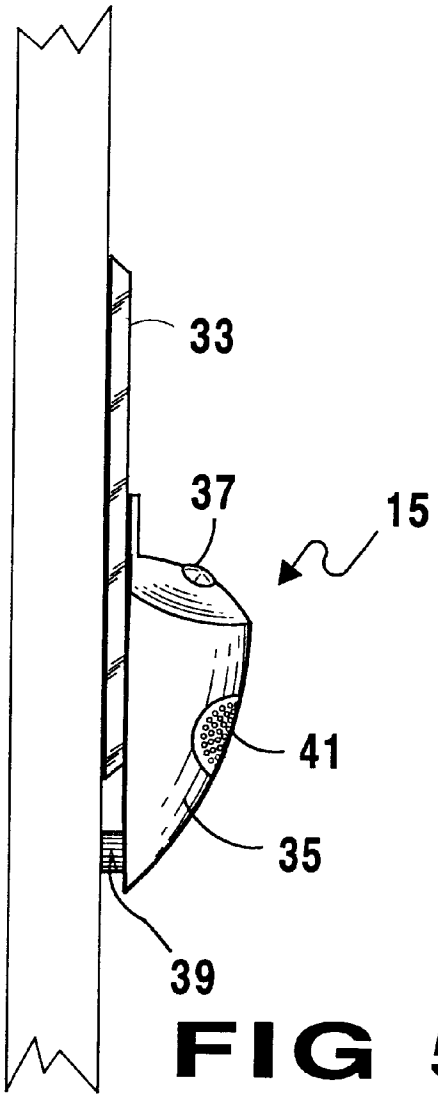
FIG. 5 is a side view of a receiver unit of the wireless smoke detection system of the present invention.
Figure 4:
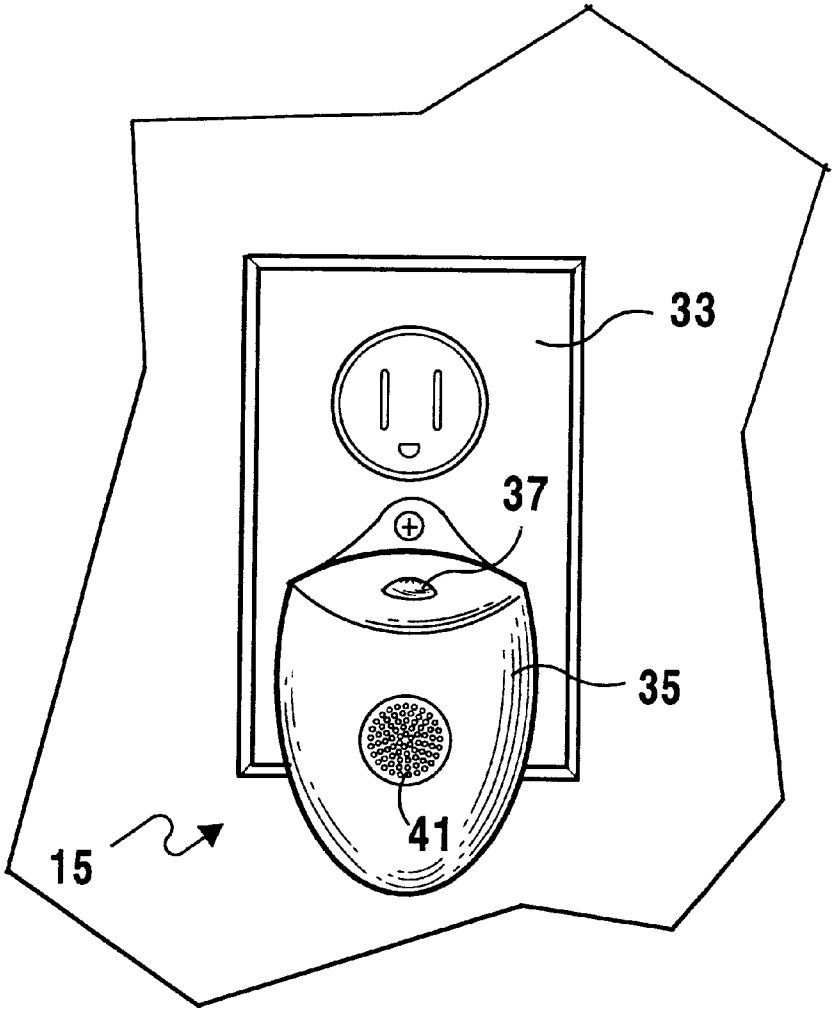
FIG. 4 is a front perspective view of a receiver unit of the wireless smoke detection system of the present invention.

A receiver unit is illustrated in FIGS. 4 and 5 and indicated generally by the numeral 15. The receiver unit 15 plugs into a standard electrical outlet 33. The receiver unit 15 includes a housing 35 having a power indicator light 37 positioned thereon indicating that power is being supplied to the receiver unit 15. As can be seen from FIG. 5, the housing 35 may include a stabilizing foot 39 extending from a base thereof for positioning the receiver unit 15 flush against a wall. The receiver unit 15 also includes an audible alarm 41 for generating an audible alarm signal upon receipt of an emergency signal from a detector unit 12.

Figure 6:
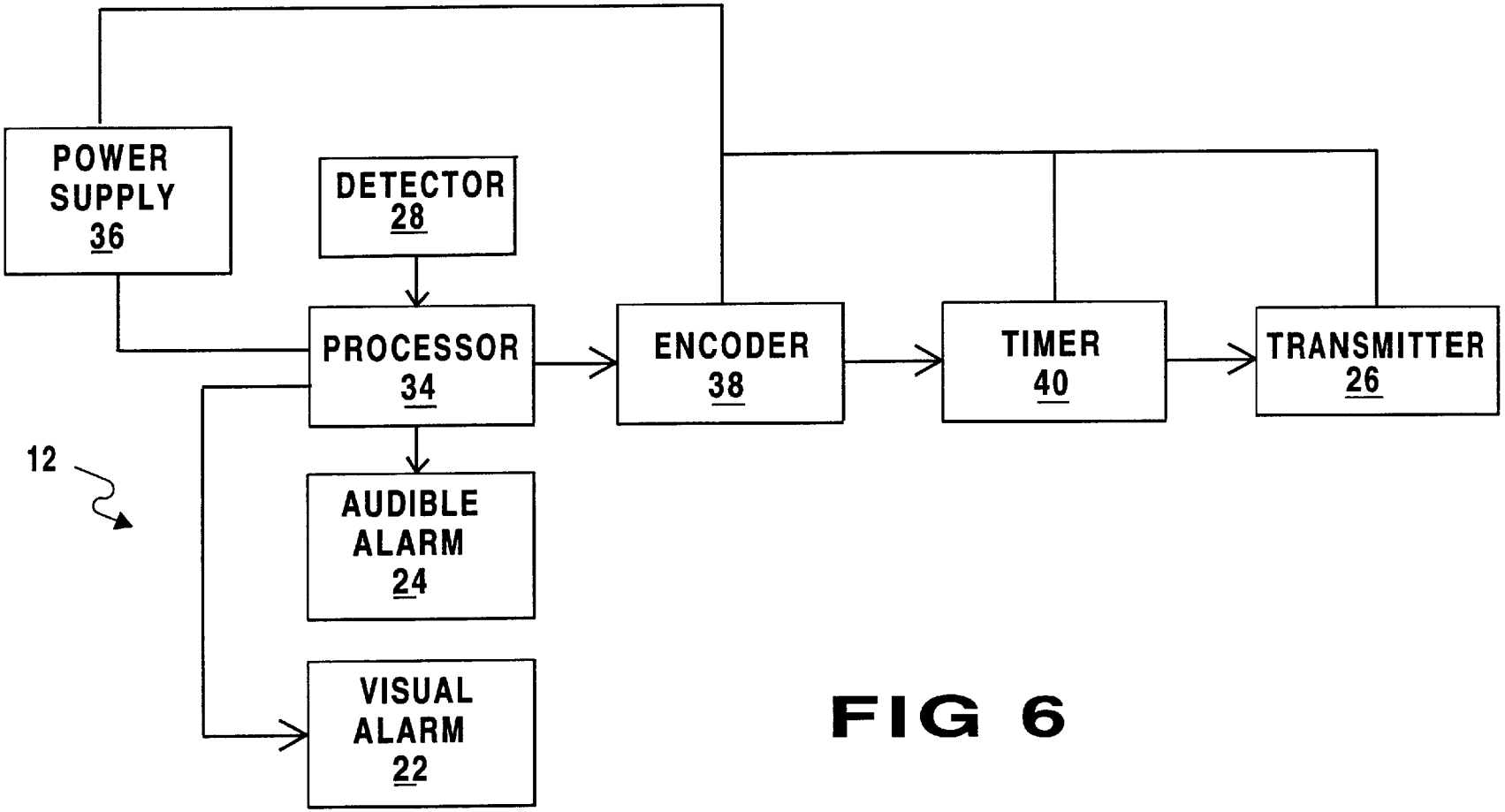
FIG. 6 is a block diagram of a detector unit of the wireless smoke detection system of the present invention.

A more detailed block diagram of a detector unit 12 is illustrated in FIG. 6. This figure shows the detector 28 connected to a processor 34. The processor 34 is connected to a power supply 36 and also to both the visual alarm 22 and the audible alarm 24. When the detector 28 detects an emergency situation a signal indicative of such is sent to the processor 34. The processor 34 activates the visual alarm 22 and the audible alarm 24 to alert persons in the monitored area as to the detected emergency situation. The processor 34 also sends a signal to an encoder 38 which encodes the signal for transmission to the receiver units 15 in the monitored area. The encoder 38 supplies the encoded signal to a timer 40 and to the transmitter 26 for delayed transmission of the emergency signal to the receiver units 15. The power supply 36 is also directly connected to the encoder 38, the timer 40 and the transmitter 26.

Figure 7:
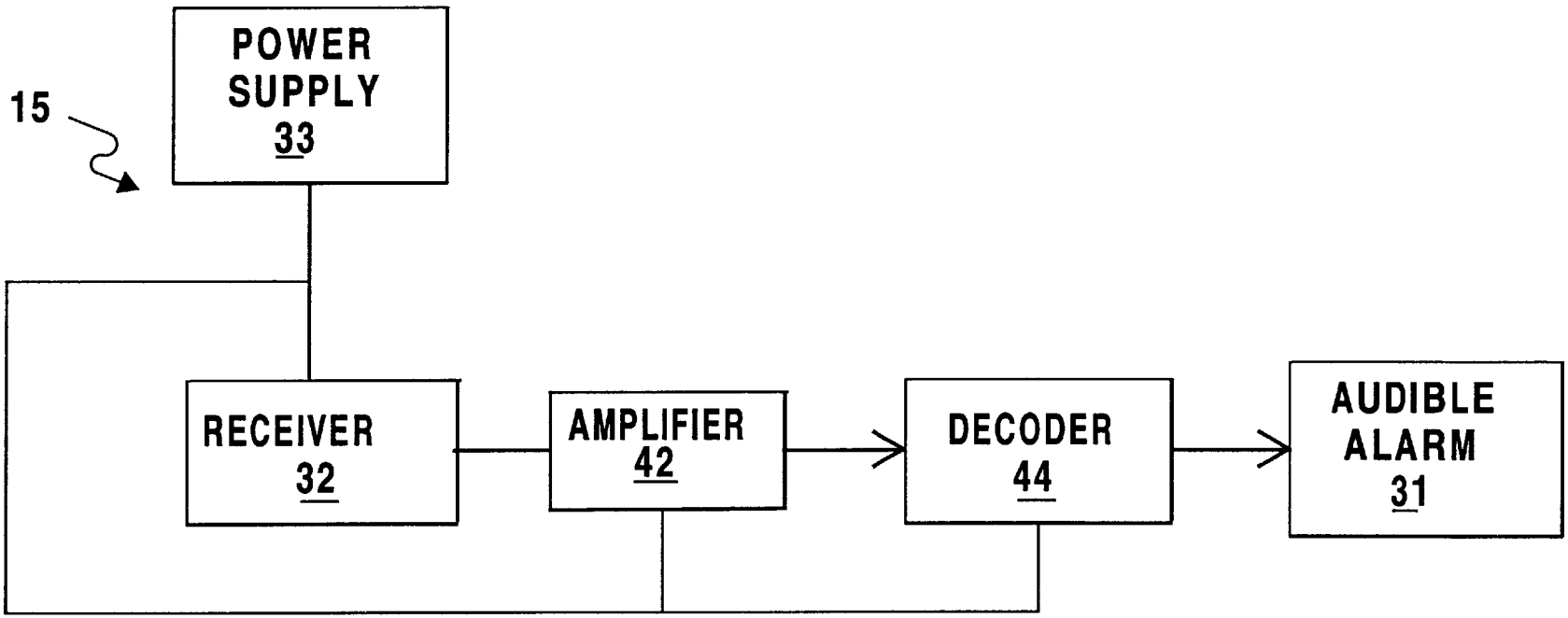
FIG. 7 is a block diagram of a receiver unit of the wireless smoke detection system of the present invention.

A block diagram of a receiver unit 15 is illustrated in FIG. 7. Each receiver unit 15 includes a receiver 32 connected to a power supply 33 such as the conventional electrical outlet shown in FIGS. 4 and 5. Upon receipt of an encoded signal from one of the detector units 12, the receiver 32 of the receiver unit 15 supplies the received signal to an amplifier 42 and a decoder 44. The amplifier 42 amplifies the received signal and the decoder 44 decodes the encoded and amplified signal. The decoded signal is then supplied to trigger the audible alarm 31 thereby alerting persons within the monitored area as to the detected emergency situation within the monitored area. The power supply 33 is also directly connected to the amplifier 42 and the decoder 44.

Figure 8:
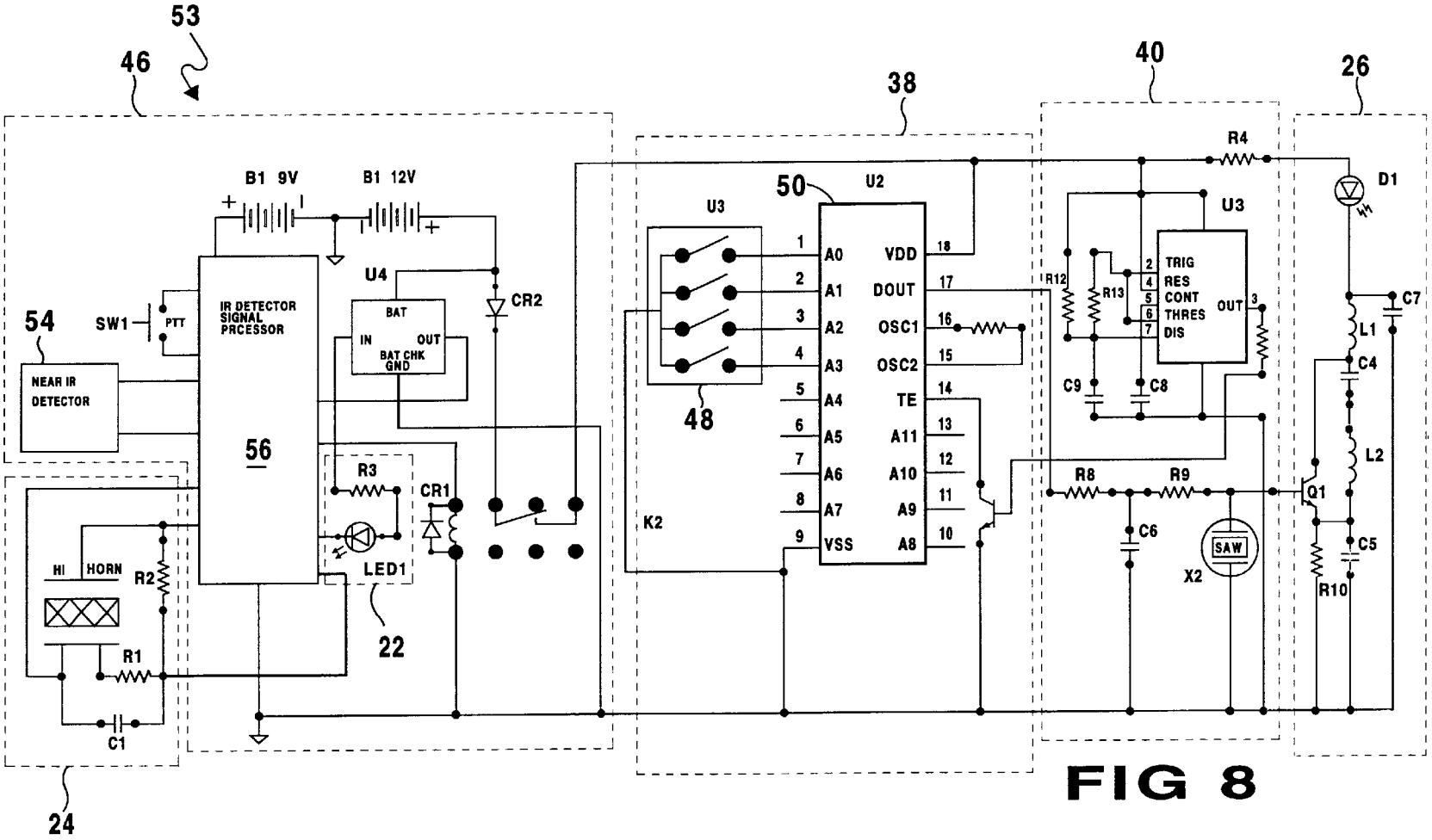
FIG. 8 is a schematic diagram of the transmitter section of a detector unit of the wireless smoke detection system of the present invention.

A schematic diagram of a detector unit 12 for detecting smoke levels within an area using a near infrared type detector is illustrated in FIG. 8. The detector 46 includes a near infrared detector 54 connected to an infrared detector signal processor 56. The infrared detector 54 continually senses the heat level in the area being monitored and sends signals indicative of the sensed values to the infrared signal processor 56. The infrared signal processor 56 analyzes the signals received from the infrared detector 54 to determine if an emergency condition exists. If an emergency condition is determined to exist, the infrared signal processor 56 sends a signal to the visual indicator 22 and to the audible indicator 24. A signal indicating the emergency situation is also sent by the infrared signal processor 56 to the encoder unit 38. The encoder unit 38 includes an encoder 50 and a code switch 48 for coding the signal for transmission. The encoded signal is provided to a transmit timer 40 for timing the signal transmission and to the transmitter 26 for transmitting the encoded signal at a predetermined frequency to the other receiver units 15 within the system 10.

Figure 9:
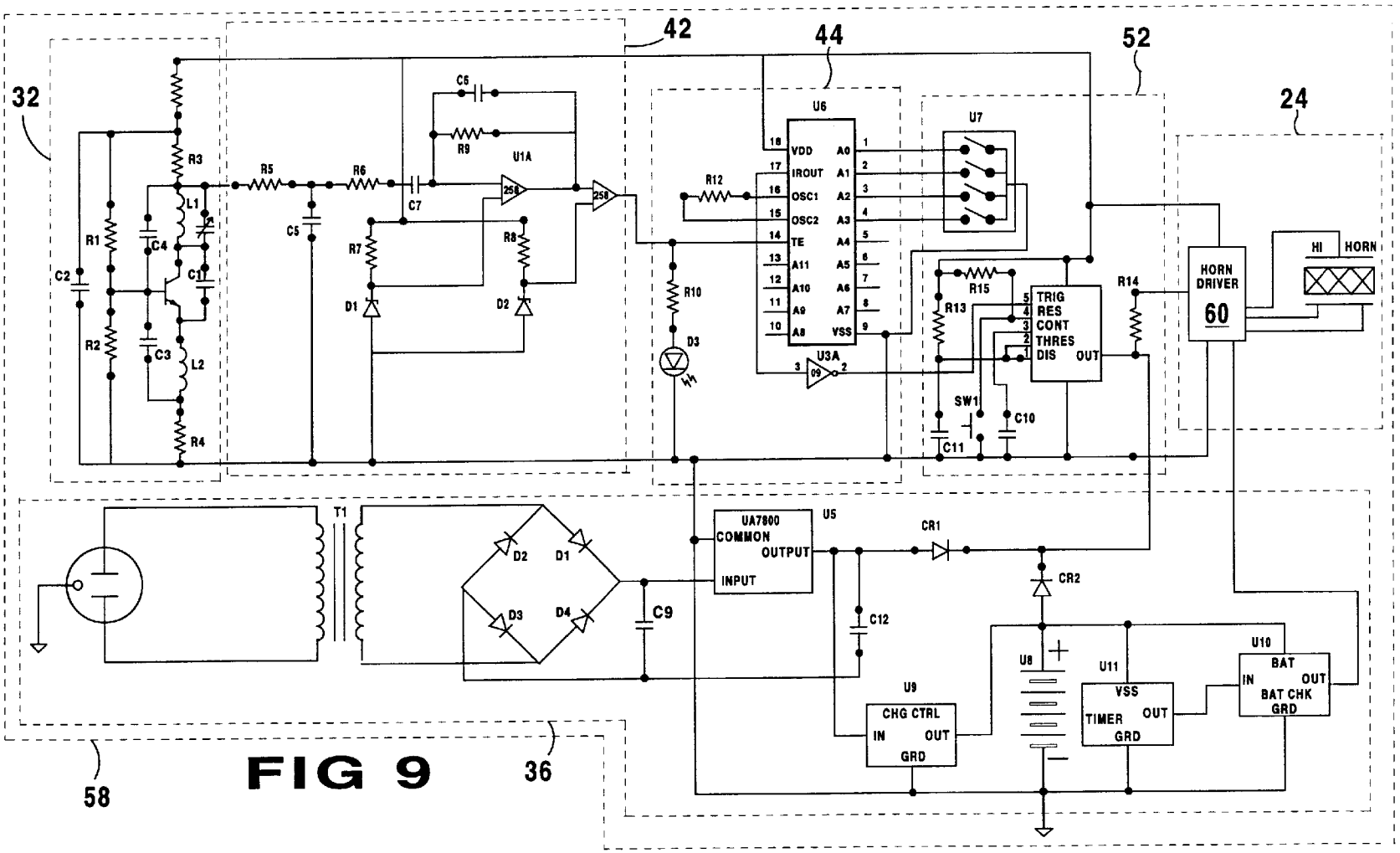
FIG. 9 is schematic diagram of the receiver of the wireless smoke detection system of the present invention.

A schematic diagram of the receiver section 58 of (the receiver unit 15 is illustrated in FIG. 9) the receiver section 58 includes the receiver 32 tuned to receive the emergency signals from the transmitter unit 53. The receiver 32 supplies the received signal to the amplifier 42 to amplify the received signal for the decoder 44. The decoder 44 receives the encoded and amplified signal and decodes the signal. The decoded signal is then sent to the code switch 52 which will be activated to trigger the audible alarm 24 and thereby generate an audible alarm signal. The signal generated by the code switch 52 is sent to the audible alarm driver 60 which is also connected to the power supply 36. The audible alarm driver 60 provides a signal to the audible alarm causing it to generate the audible alarm signal and thereby alert all persons within the area monitored by the detector unit 12 as to the existence of an emergency situation within the area being monitored by the system 10.

Figure 10:
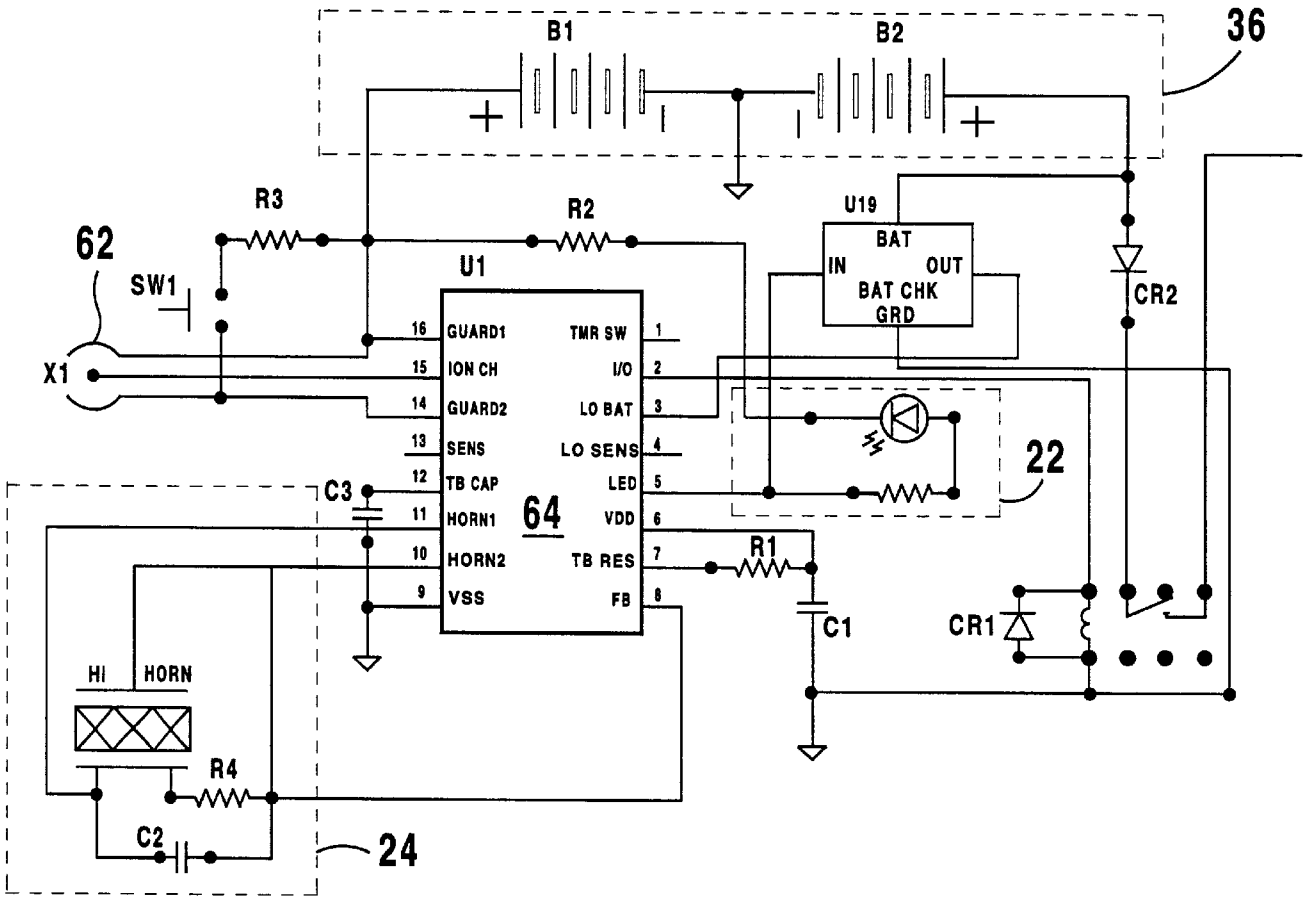
FIG. 10 is a schematic diagram of an ionization type smoke detector for use in a detector unit of the wireless smoke detection system of the present invention.

An alternate type of detector 46 which may be used to detect an emergency situation is illustrated in FIG. 10. This detector 46 is an ionization type smoke detector. This detector 46 includes an ion gauge 62 for measuring the ionization level in the atmosphere of the area monitored by the detector unit 12. The ion gauge 62 is connected to a signal processor 64 which analyzes the signal received from the ion gauge 62 to determine if an emergency situation exists. Upon determining an emergency situation exists, the signal processor 64 sends a signal to both the visual alarm 22 and the audible alarm 24 causing each to generate an alarm signal. The alarm signal generated by both the visual alarm 22 and the audible alarm 24 alert persons in the vicinity of the monitored area that an emergency situation exists at some position within the monitored area.

Figure 11:
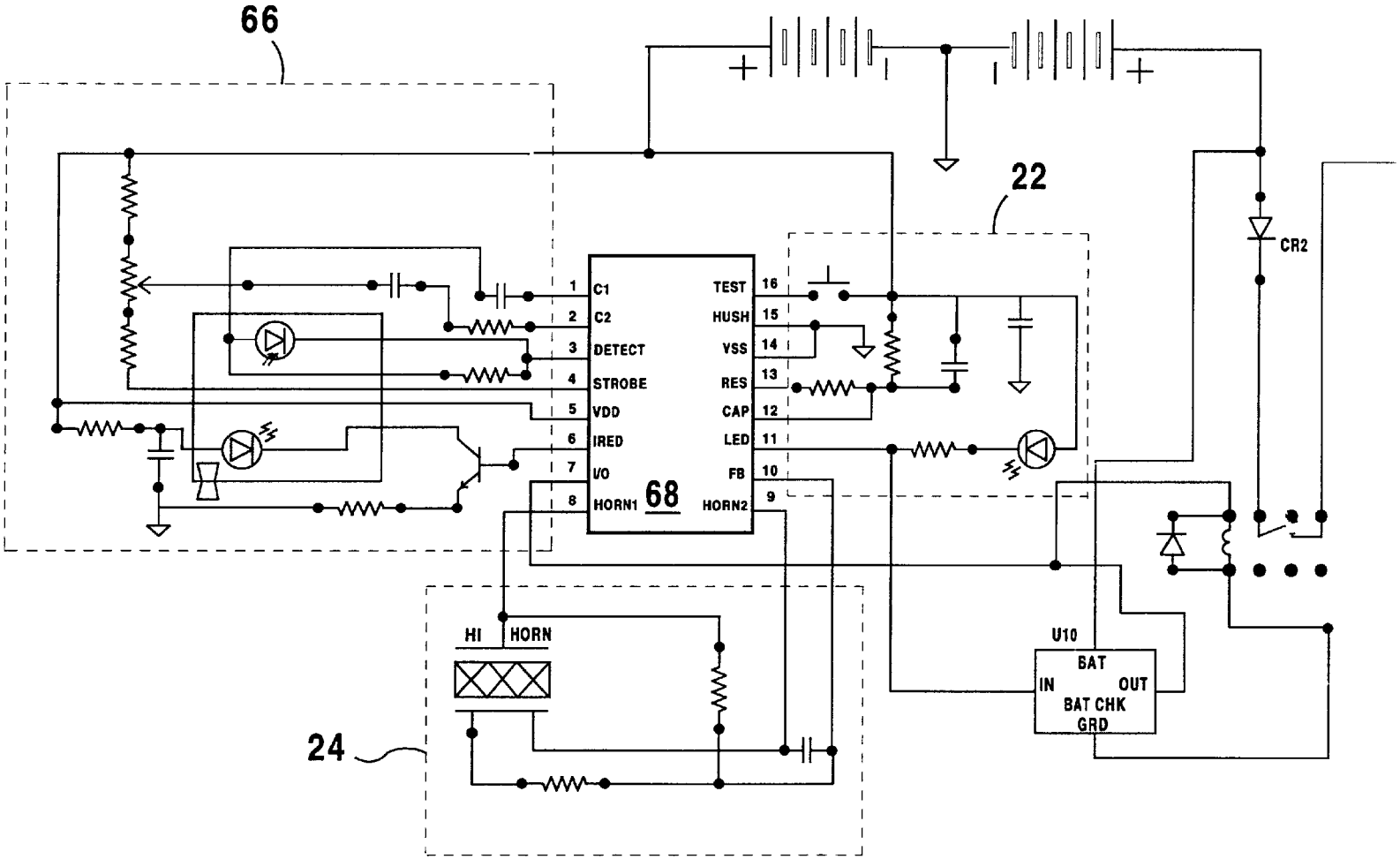
FIG. 11 is a schematic diagram of an photoelectric type smoke detector for use in a detector unit of the present invention.

A photoelectric type smoke detector used to detect an emergency situation may also be used in lieu of the detector 46 illustrated in FIG. 11. The photoelectric type smoke detector includes photoelectric diodes 66 connected to form a circuit for measure the amount of smoke in the area monitored by the detector unit 12. The photoelectric diodes 66 provide a signal to a photoelectric signal processor 68. The photoelectric signal processor 68 analyzes the signal received from the photoelectric diodes 66 to determine if an emergency situation exists. Upon determining an emergency situation exists, the signal processor 68 sends a signal to both the visual alarm 22 and the audible alarm 24 causing each to generate an alarm signal. The alarm signal generated by both the visual alarm 22 and the audible alarm 24 alert persons in the vicinity of the monitored area that an emergency situation exists at some position within the monitored area.

The operation of the wireless smoke detection system 10 will now be described with reference to the figures. In operation, the detector units 12 and the receiver units 15 of the wireless smoke detection system 10 are strategically positioned throughout an area to be monitored whereby the entire area is able to be monitored. For example, if the area to be monitored is a building then a user may position the detector units 12 and receiver units 15 in each room and also in common areas between rooms such as hallways and lobbies. Thus, the entire area can be accurately monitored and wired for alerting per sons within the area as to detected emergency situations. If an open area is to be monitored then the receiver units 15 should be positioned separated from each detector unit 12 by a distance equal to the transmission range of the detector units 12 with possibly a slight overlapping of transmitting range of the detector units 12. The detector units 12 should be separated by a distance slightly less than the individual monitoring range of each thus allowing for monitoring of the entire area.

Once positioned throughout the area to be monitored, the detectors 46 are turned on and begin monitoring the area. The receivers are also turned on by, for example, plugging them each into an electrical outlet. The detectors 46 continually send monitoring signals to their respective processor for analysis. If the processor determines that the detector 46 has monitored an emergency situation, e.g. a level of a monitored substance within the ambient atmosphere around the detector unit 12 which exceeds a predetermined limit value then an alarm signal is generated. The alarm signal is sent to the visual alarm 22 and audible alarm 24 for triggering the generation of the visual and audible alarm signals. The alarm signal is also sent to an encoder 8 to be encoded prior to transmission. After the alarm signal is encoded it is transmitted to the receiver units 15 in the area being monitored. The receiver units 15 receive the encoded signal and decode the signal in their decoder 44. The decoded signal is then sent to trigger the audible alarm 31 to generate the audible alarm signal. The generation of the audible alarm signal alerts persons within the area being monitored that an emergency situation exists at some position within the monitored area.

The detector units of the present invention are able to monitor any of a plurality of different characteristics and qualities of the area being monitored. The detector units can each or all be any one of a near infrared smoke detector, a photoelectric smoke detector, an ionization type detector, a combination carbon monoxide and smoke detector, a carbon monoxide detector and a hazard detector.

While a preferred structure for the detector units is shown and described herein, those of ordinary skill in the art who have read this description will appreciate that there are numerous other structures for the detector units and, therefore, as used herein the phrase "means for detecting one of a characteristic and condition within a section of the monitored area" should be construed as including all such structures as long as they achieve the desired result of detecting one of a characteristic and condition within a section of the monitored area, and therefore, that all such alternative mechanisms are to be considered as equivalent to the one described herein.

From the above description it can be seen that the wireless smoke detection system of the present invention is able to overcome the shortcomings of prior art devices by providing a wireless smoke detection system which is able to alert a person in a section of the area being monitored to an emergency situation in a remote section of the monitored area. The wireless smoke detection system includes a plurality of detector units strategically positioned in the area to be monitored which include a transmitter able to provide communication with a plurality of receiver units positioned within the area to be monitored and trigger generation of an alarm signal by the receiver units upon detection of an emergency situation. The wireless smoke detection system is able to monitor a plurality of hazardous conditions such as hazardous levels of smoke, carbon monoxide and other conditions and relay an emergency signal to receiver units in the system upon detection of an emergency situation thereby alerting individuals within a structure or area being monitored to the existence of an emergency situation within the area or structure. Furthermore, the wireless smoke detection system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wireless detection system monitoring a predetermined area for an emergency situation, said wireless detect on system, comprising a plurality_of detector units and a plurality of receiver units strategically positioned throughout the monitored area, each of said detector units comprising:

a) means for detecting one of a characterstic and condition within a section of the monitored area and generating a signal indcative of the monitored conditionl;

b) signal processing means for analying said signal generated by said detecting means and upon determining if the signal is above a predetermined levele generating an emergency signal;

c) means for transmitting wirelessly said emergency signal including means for delaying transmission of the signal; and d) means for generating an alarm signal upon receipt of said emergency signal from said signal processing means, said alarm signal alerting persons of an emergency situation at a position within the monitored area; and each of said plurality of receiver units includes:

a) a housing containing means for receiving said emergency signal generated by any of said plurality of detector units;

b) said housing also containing means connected said receiving means for generating an alarm signal upon receipt of said emergency signal; and c) said housing having means for plugging into a standard electrical outlet for receiving electrical power, a power indicator light to indicate that electrical power is being supplied to said receiver unit, and a stabilizing foot extending from a base of said housing for positioning the housing flush against a wall whereby said receivers may be moved and located where most convenient for alerting people of any emergency situation;

e) each of said detectors further includes means for encoding said emergency signal prior to transmission by said transmission means and each of said receivers further include means for amplifying and decoding said emergency signal upon receipt by said receiving means;

f) wherein each of said plurality of detectors is one of a near infrared smoke detector, a photoelectric smoke detector, an ionization type detector, a combination carbon monoxide and smoke detector, a carbon monoxide detector and a hazard detector.

* * * * *